US005664020A

United States Patent [19]

Goldfarb et al.

[11] Patent Number: 5,664,020

[45] Date of Patent: Sep. 2, 1997

[54] COMPACT FULL-RANGE LOUDSPEAKER SYSTEM

[75] Inventors: Barry S. Goldfarb, Deland, Fla.; Robert L. Clark, Durham, N.C.

[73] Assignee: BSG Laboratories, Deland, Fla.

[21] Appl. No.: 414,418

[22] Filed: Mar. 31, 1995

Related U.S. Application Data

[63] Continuation-in-part of Ser. No. 181,808, Jan. 18, 1994, Pat. No. 5,450,495.

[51] Int. Cl.[6] ..... H04R 1/02; A47B 81/06

[52] U.S. Cl. ..... 381/89; 381/88; 381/159; 181/196; 181/199

[58] Field of Search ..... 381/89, 88, 90, 381/158, 159, 160, 151, 156, 24, 205; 181/151, 143, 144, 145, 146, 153, 196, 198, 199, 182, 186

[56] References Cited

U.S. PATENT DOCUMENTS

| | | | |
|---|---|---|---|
| 2,905,259 | 9/1959 | Ashe . | |
| 3,818,138 | 6/1974 | Sperrazza . | |
| 3,945,461 | 3/1976 | Robinson . | |
| 4,164,988 | 8/1979 | Virva . | |
| 4,268,719 | 5/1981 | Manger . | |
| 4,655,315 | 4/1987 | Saville . | |
| 4,753,317 | 6/1988 | Flanders . | |
| 4,756,382 | 7/1988 | Hudson, III | 181/156 |
| 4,905,788 | 3/1990 | Lanternier . | |
| 5,073,945 | 12/1991 | Kageyama et al. . | |
| 5,082,084 | 1/1992 | Ye-Ming | 181/153 |
| 5,191,177 | 3/1993 | Chi . | |
| 5,450,495 | 9/1995 | Goldfarb | 381/89 |

*Primary Examiner*—Sinh Tran
*Assistant Examiner*—Xu Mei
*Attorney, Agent, or Firm*—Quarles & Brady

[57] ABSTRACT

A compact full-range loudspeaker system includes an elongated enclosure having two open ends joined by a hollow interior, which enclosure may be of fixed dimension or telescoping, and has a full-range speaker mounted at each end of the cylindrical enclosure. The enclosure length is set in a range governed by the small speaker size to maximize the system response, particularly in the lower frequency range, and a dampening material is provided to construct the enclosure to minimize the structural acoustic response of the enclosure when being driven. A pair of miniature sound boards may be flat, polymer surfaces mounted to a base and positioned at each end of the cylindrical enclosure at an angle facing each speaker for reflecting sound waves emanating from the speaker in accordance with the positioning of the cylindrical enclosure to create an effective sound stage and control directionality.

17 Claims, 4 Drawing Sheets

COMPACT FULL-RANGE LOUDSPEAKER SYSTEM

CROSS-REFERENCE TO RELATED APPLICATION

This is a continuation-in-part of U.S. patent application Ser. No. 08/181,808, filed Jan. 18, 1994, now U.S. Pat. No. 5,450,495 issued Sep. 12, 1995.

FIELD OF THE INVENTION

The present invention relates to loudspeaker systems, and more particularly to integrated, single enclosure systems for full-range stereo audio loudspeakers.

BACKGROUND OF THE INVENTION

In the past, efforts have been made to provide full range stereophonic sound in enclosures that are small and compact. The compact size is desirable for a multitude of home, automotive and commercial applications. However, the development trends in producing stereophonic sound in this environment have focused on small but separate enclosures for the speakers providing the separate stereo channels. Further, the separate, small enclosures for full range audio have had relatively limited performance in the bass frequency region. Thus, the bass range signals are typically separated and directed to a third enclosure dedicated and designed to enhance bass performance. These enclosures are sometime referred to as subwoofer satellites. Because humans do not readily perceive the direction of sound below around 500 Hz, the use of a single subwoofer satellite in monaural configuration is typically provided.

One known technique for improving bass response in larger systems, such as subwoofer satellites, is the positioning of opposing loudspeakers at opposite ends of a hollow cylindrical enclosure so that the loudspeakers enclosed and are mechanically coupled by a volume of air. As developed more fully below, the loudspeakers can be driven by in phase electric signals to produce a mechanically out of phase response. A push-pull effect is achieved in the bass frequency region, whereby the loudspeakers are acoustically in phase, and the resulting sound waves augment each other in the bass frequency region for increased sound intensity.

Because of the increased bass performance, the opposing speaker configurations have been directed to relatively large loudspeakers having diameters greater than six inches. Additionally, these constructions have traditionally been improved for bass region performance by stiffening the enclosure, resulting in an enclosure response with a resonant frequency well above the bass frequency range in which the loudspeakers perform. Hence, the interference by vibration of the enclosure at its resonant frequency is avoided by the limited range of the loudspeakers.

It would be desirable to obtain the benefits of the bass region performance of an opposing loudspeaker enclosure in a compact size capable of stereophonic full bandwidth audio.

SUMMARY OF THE INVENTION

It is an object of the invention to provide a compact full-range loudspeaker system that utilizes the response and size benefits of an enclosure with opposing speakers.

It is another object of the invention to provide a full-range loudspeaker system that delivers superior full-range bandwidth audio in a compact enclosure.

It is yet another object of the invention to provide a full-range loudspeaker system that utilizes an opposing speaker configuration with little or no undesired overtones.

It is a further object of the invention to provide a full-range loudspeaker system that can be used as a component of a larger system utilizing spatial and temporal processing to optimize the observer's psychoacoustic experience.

These and other objects of the invention are achieved by a compact full-range loudspeaker system having an elongated enclosure with opposing open ends connected by a hollow, elongated interior. An audio speaker having a full audio bandwidth response range is mounted in each open end, with the audio loudspeakers being axially aligned and facing outwardly from the enclosure.

Significantly, the loudspeaker system provides stereo full audio range output in a single compact enclosure. According to the invention, the loudspeakers are 4.25 inches or less in diameter and the enclosure length is preferably 0.2 m or less, and in any event, less than 0.5 m, but is greater or equal to the twice the radius of each audio speaker. In this range, the modal density and associated standing waves are optimal for enhanced low-range bass performance while allowing full range performance.

To achieve this construction for full range sound without the interference of enclosure vibrations, the invention provides means for controlling the structural acoustic response of the enclosure in the reaction to the sound field created by the loudspeakers and length geometry. A dampening material minimizes or virtually eliminates responsive vibrations in the enclosure, particularly at the resonant frequency of the enclosure where vibrations would otherwise be sufficiently large to interfere with the sound field of the system.

The dampening material forms at least part of the enclosure and is preferably a viscoelastic material. Preferably, a butyrate, such as Butyrate 565, is used as a layer of the enclosure.

This material construction works with the length of the enclosure to enhance the performance of the system. The length should in general measure at least twice the radius of the driver used. While increasing the length will result in a higher modal density (i.e., number of standing waves per fixed frequency bandwidth) within the enclosure, the apparent stiffness associated with the air-spring between the two drivers decreases, improving the system performance at low-frequencies.

The increased number of acoustic standing waves does not deteriorate the acoustic response of the loudspeaker system since the structural acoustic response of the cylinder is minimized as a result of the damping means provided by the Butyrate 565 material.

The directionality of the system output can be controlled by deflector surfaces, for example, by vertical panels mounted on supporting bases, that are aligned with an enclosure axis extending between the centers of the opposing audio speakers. The panels are angled to project the sound laterally, generally perpendicular to the enclosure axis.

This direction control is of particular benefit to a preferred application of the loudspeaker system as a component of a larger spatial and temporal signal processing system. The highly directional full-range output of the loudspeaker system can be blended with the low-range, non-directional output of a larger bass enclosure and the mid-range output of a further enclosure to create a realistic psychoacoustic experience for the listener that utilizes a compact construction for the full-range sound output.

As a variable embodiment, the device can be constructed in a telescoping configuration such that the user can selectively tune the device within the acoustical environment in which it is placed. An alternative embodiment might incorporate a flexible folding, expanding and contracting assembly, such as a bellows, to modify the dynamics associated with the enclosure. Since the acoustics of rooms vary dramatically, this flexibility in design affords the user with a freedom not offered in conventional systems.

DESCRIPTION OF PREFERRED EMBODIMENTS

The loudspeaker system of the invention provides full audio bandwidth stereophonic sound in a single compact enclosure. As used throughout the application, full range or full bandwidth refers to a range generally extending 20 Hz to 20 kHz, but in any event below 500 Hz and above 12 kHz.

The system can also provide controlled directionality through deflector surfaces. The system has a variety of applications including audio enhancement of television viewing and multimedia computer games. However, the system is preferably used as a component of a larger spatial and temporal signal processing system to enhance the psychoacoustic experience of the observer. As used here and below, observer connotes that the experience is more than listening and may include other sensory phenomenon such as feeling vibrations and perceiving bodily location within or without the auditory experience.

In general, the invention provides an elongated enclosure with a hollow interior joining two opposing open ends. A full-range speaker is mounted in each of the open ends and is supplied with a driving signal from an audio amplifier or the like. According to the invention, the length of the enclosure and the materials used to construct the enclosure are combined to provide a full-range response from an enclosure design previously reserved for only large, bass frequency systems. The length is set in a range from twice the radius of the speakers to less than 0.5 m and is housed in an enclosure preferably made at least partly of a dampening material to limit the structural acoustic response around the resonant frequency of the enclosure.

Figure 1:
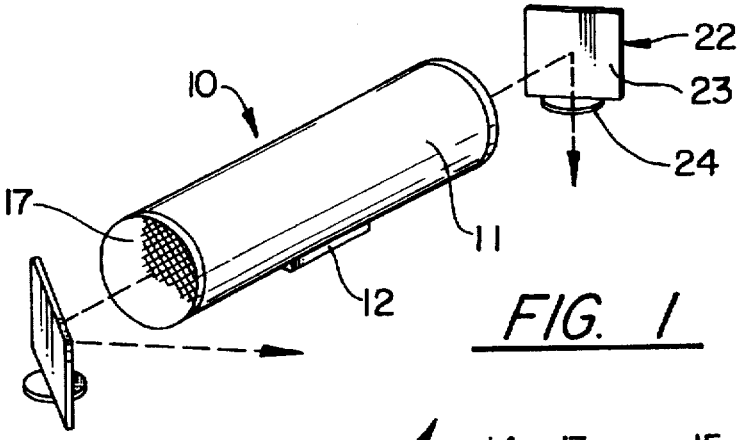
FIG. 1 illustrates a perspective view of a sound system in accordance with the present invention.
Figure 2:
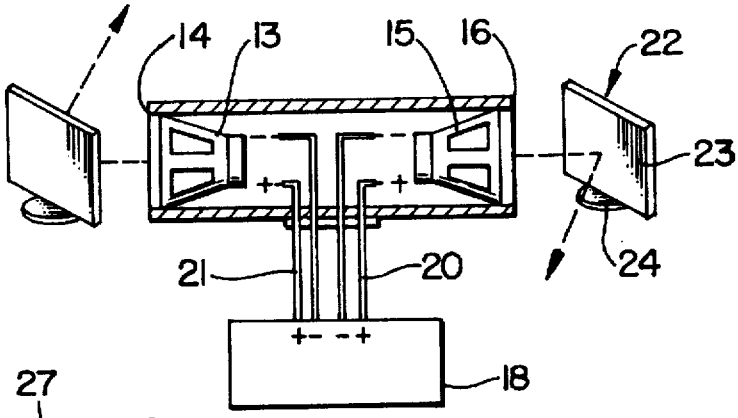
FIG. 2 depicts a sectional view of the sound system cylindrical enclosure of FIG. 1 interconnected with a stereophonic amplifier.

Referring to the drawings and especially to FIGS. 1 and 2, a compact full-range stereophonic sound system 10 is illustrated having an elongated enclosure 11. The preferred construction, as illustrated, is cylindrical with a circular cross section. Alternative polygonal cross-sectional arrangements are possible, provided the enclosure provides a hollow interior joining two opposing, open ends.

The cylindrical enclosure 11 has in the preferred embodiment a full-range speaker 13 mounted in one end 14 thereof and a full-range speaker 15 mounted in the second end 16 of the cylindrical enclosure 11. Each speaker 13, 15 can have a speaker grill 17 covering the front of the speakers 13, 15. Speakers 13, 15 are both directed to emanate directly from the outside of the tube 11 180 degrees from each other.

The electro-mechanical, structural acoustic response of each driver 13, 15 is selected such that they are appropriately matched to deliver a uniform sensitivity over the applicable full range bandwidth required for reproduction of the sound field. The full range loudspeakers 13, 15 are preferably equipped to provide full audio bandwidth output in response to signals ranging from 20 Hz to 20 kHz. Alternatively, speakers having a more limited range can be utilized, but in any event should have a range extending above the low bass range above 500 Hz because the benefits of the enclosure construction of the invention is not fully obtained in just the bass region. Thus, a limited frequency range for use in the system of the invention should extend above 150 Hz and at least to 10 kHz. The system can also utilize co-axial and tri-axial drive units.

Because of the energy absorption of the dampening means, the loudspeakers should be powerful relative to their size. According to the invention, the compact size is partly provided by the loudspeakers being no more than 4.25 inches in diameter. The preferred full-range loudspeaker is a 2.5 inch Sanyo Model No. S065G49B (made by Sanyo Electric Co., Ltd.) with 15 watts RMS and 20–25 watts peak capacity, but a minimum rating could be 8 watts RMS and 15 watts peak.

The cylindrical enclosure 11 has been sized such that the two drivers 13 and 15 are set mechanically out-of-phase with each other at low frequencies to create a push-pull effect and enhance the bass performance of the loudspeaker system without sacrificing the stereo effect over the mid- and high-frequency range.

The enclosure 11 can be made of a predetermined length and sits on a flat based member 12 which prevents the enclosure from rolling but can also be used for attaching the cylindrical enclosure to a wall or the like.

Referring to FIG. 2, the acoustic loudspeakers employed are relatively inefficient in the embodiment presented; however, the loudspeaker system is supplied sufficient power to overcome any deficiencies in particular transducers employed by a sound power source 18 which may include a stereo amplifier receiver and may receive a sound input from a CD player or the like which is conducted through the cables 20 to the stereo speaker driver 15 and through the cables 21 to the driver 13. The drivers 13 and 15 are carefully placed at the furthest point from each end 14 and 16 thereof and are faced back to back aligned on the center axis of the cylindrical enclosure 11 so that the audio energy emanates from the front of each driver 13 and 15 and from each end of the cylindrical enclosure.

The directionality of the audio output is controlled by a pair of miniature sound boards 22, each having a plate 23 for deflecting the acoustic waves, which is illustrated as a flat plate but also can be a shaded arcuate plate, if desired. Each deflector surface 23 is mounted to a base 24 which allows it to stand upright on a surface and to be aligned at any angle desired, depending upon the placement of the cylindrical enclosure 11 resting on its base 12.

For example, different angles are shown in FIGS. 1 and 2, the latter of which reflects the acoustic waves at opposite angles to each other. It should be understood that these miniature sound boards have no effect on the low frequency sound waves as the wavelength of these acoustic waves far exceed the dimensions of the sound boards. However, over the frequency range where the ear has greater sensitivity, these miniature sound boards serve to create the sound stage and the perceived directionality of the sound field. Thus, the psychoacoustic impact of the loudspeaker system is a perception of appropriate directionality for the sound field. It should be clear that the miniature sound boards can be rotated 360 degrees and thus have variations of angles over 180 degrees.

One should also recognize that a dual mono source input can be utilized within the sound system design. Thus, the choice of transducers and stereophonic verses monophonic audio depends upon the chosen application for the sound system. In the stereophonic configuration, the invention details a very compact sound system incorporated into a single enclosure which can produce a full range of audio output and which can vary the sound stage for a stereo system to meet the preferences of the observer.

Limiting the structural acoustic response around the resonant frequency of the enclosure may be accomplished in a variety of ways. First, and preferably, the enclosure 11 can be made at least partially of a dampening material. The dampening material can be provided as a layer or layers on the interior or exterior surface(s) of a substrate forming the elongated enclosure. The layers Could consist of polyester, vinyl, or mylar, but Butyrate 565, a viscoelastic material manufactured by the Eastman Chemical Company, is the preferred material for the loudspeaker system. Thin ABS plastic, particularly if coated by a viscoelastic material may also be used.

In the preferred embodiment, the enclosure 11 is made of a structural substrate such as paperboard and coated with the viscoelastic material, such as Butyrate 565. The viscoelastic coating can be 0.06 inches. This viscoelastic material serves to dampen the structural acoustic response of the cylinder and thus minimize sound radiation emanating from the surface of the enclosure. Increased damping of the structure serves to suppress the reverberant response of the cylindrical modes which can result in acoustic inefficiencies, since the motion of the enclosure is typically out-of-phase with that of the speakers as configured.

As used throughout this application, a viscoelastic material is one that displays both fluid like (viscous) and solid like (elastic) characteristics. At room temperatures, the materials display behavior that can be described as somewhere between "leathery" and "rubbery" in a qualitative sense. In the leathery region, the polymer can be deformed, and slowly returns to its original shape. In the rubbery form, upon deforming the material, it quickly returns to its original shape. As the melting temperature of the material is approached, it tends to a viscous (fluid-like) state.

Viscoelastic materials are generally classified in terms of the degree of cross-linking between polymers. Cross-linking is defined as the joining of adjacent linear polymeric molecules by chemical bonding (such as in vulcanized rubber). Any elastomer such as natural or synthetic rubber can be cross-linked to produce different degrees of rigidity and concurrently offer a hysteretic damping mechanism.

In general, when used as an enclosure for a loudspeaker such as the invention, the level of cross-linking must be sufficient to maintain form of the enclosure, but not too excessive so as to inhibit the dissipation of acoustically induced mechanical energy. Under cyclic loading, the viscoelastic material exhibits hysteresis, and the area enclosed by the hysteretic curve dictates the level of energy which can be dissipated from the system. While the invention is constructed from Butyrate, any viscoelastic material ranging from as little as 10% cross-linking to as much as 90% cross-linking can be employed to construct an enclosure. In addition, additives such as plasticizers can be used to strengthen the structure.

In general, the level of rigidity required for the enclosure will be dependent upon the relative mass of the drivers and moving coil system. However, the implementation is not limited to Butyrate or enclosures constructed solely from viscoelastic materials. In general, sandwich type construction techniques common to the composites industry can be employed to construct an enclosure with viscoelastic layers sandwiched between constraining surface layers such as metal or plastic. While this construction is more complex, it can be used to achieve the same effect: passive dissipation of mechanical energy.

All elastomer materials (i.e., any rubber, synthetic or natural) can be effectively cross-coupled to create the appropriately stiffened, viscoelastic enclosure required to dissipate the kinetic energy of the enclosure resulting from acoustic excitations.

The combination of the length range and dampening material according to the invention enables full-range sound to be produced in a compact, opposing speaker configuration previously available only for bass frequency systems. The enhanced performance of the full-range system in view of these combined parameters is supported by the following development.

Figure 4:
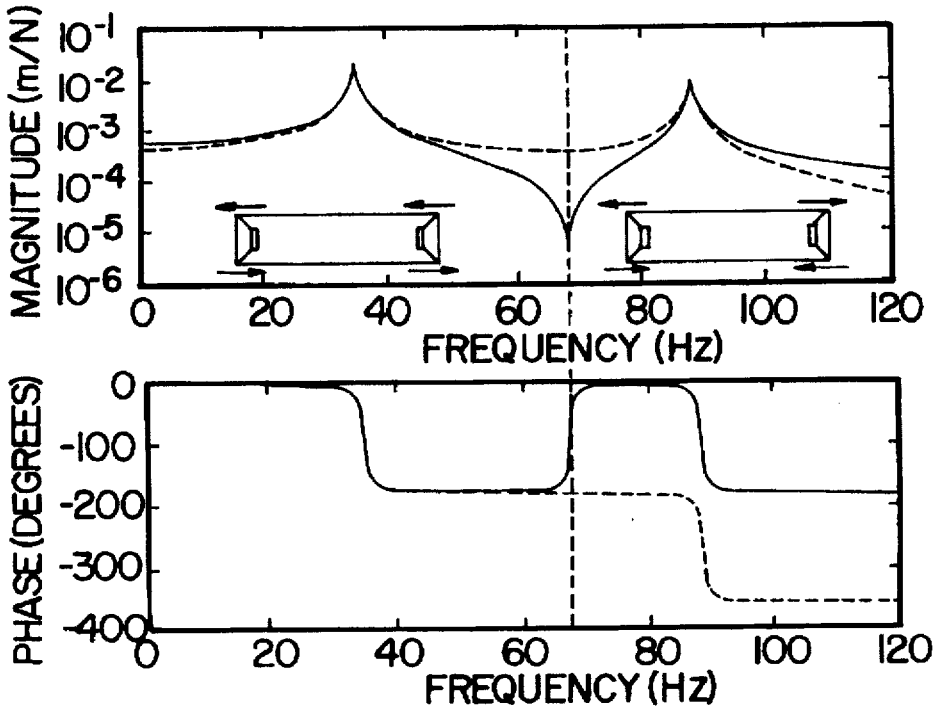
FIG. 4 illustrates a typical, mechanical frequency response for a dual-drive system coupled by an enclosed volume such as that presented in FIG. 1.

First, to emphasize the importance of the push-pull effect, consider the typical mechanical frequency response of the transduction devices 13 and 15 mounted within the cylindrical enclosure 11 illustrated in FIG. 1. A schematic diagram of the mechanical system is presented in FIG. 8. As indicated, the mass of the moving coil and air loading associated with each transduction device is connected by the effective air spring provided by the acoustic pressure within the enclosure when approximating the enclosure with lumped elements (i.e., a Helmholtz resonator). Based upon this model, there are two mechanical degrees of freedom, yielding a 4th order system with two resonance frequencies and two modes of vibration as illustrated in FIG. 4. Typical Thiele-Small parameters are selected for the transduction devices and a length of 0.2 meters is selected for the cylindrical enclosure. The stiffness associated with the enclosed volume of air was computed as follows:

$$K = \frac{\rho_o c^2 \pi r^2}{L} \tag{1}$$

where $\rho_o$ is the density of air, K is the stiffness of the "air-spring", c is the speed of sound in air, r is the radius of the enclosure, and L is the length of the enclosure. The above equation applies only to a cylindrical enclosure. For typical dimensions associated with the loudspeaker system, K=2607 N/m.

Using the Thiele-Small parameters of typical transduction devices and the computed stiffness of the enclosed volume, the vibration response of the system was computed as a function of an applied force, which can be generated through electro-mechanical transduction. The displacement response of each driver was computed as a function of an applied force to driver 13. The solid line in FIG. 4 represents the mechanical response of driver 13, and the dashed line represents the mechanical response of driver 15. As indicated, the rigid-body mode dominates the mechanical response below approximately 68 Hz, which dictates that for an applied force on one drive element, the resulting mechanical response of each element is in-phase and the acoustical response is thus out-of-phase. However, note that the mechanical response of each element is 180 degrees out of phase above 68 Hz (the position of the zeros) and thus the push-pull effect is achieved whereby the acoustic response of each driver is in phase. This mode of operation is much more efficient for enhancing the low-frequency response of the system. In fact, if mono signals are applied to the drivers in the low-frequency regime where directionality cannot be resolved by the ear (roughly speaking below 500 Hz) the two units will be forced to respond with a push-pull effect to enhance the low-frequency bass response of the system. Increasing the length of the enclosure will reduce the stiffness associated with the enclosed volume as indicated in equation (1) and thereby enhance the bass-response of the system. A minimum length of twice the radius of the driver is required for reasonable low-frequency performance. However, as outlined earlier, increasing the length excessively increases the modal density of the acoustic modes within the enclosure and thus the number of standing waves which result.

The homogeneous wave equation for the enclosed volume of air can be expressed as follows in cylindrical coordinates:

$$\left(\frac{\partial^2}{\partial r^2}+\frac{1}{r}\frac{\partial}{\partial r}+\frac{1}{r^2}\frac{\partial^2}{\partial \theta^2}+\frac{\partial^2}{\partial z^2}\right)\psi_n+K_n^2\psi_n=0 \quad (2)$$

where r is the radius, θ is the angular coordinate, z is the axial position, $K_n$ is the wavenumber and ψ(r,θ,z) is the acoustic mode. Assuming the solution is separable in space and applying the rigid-wall boundary conditions, the following expression is obtained for the acoustic mode shapes:

$$\psi_n(r,\theta,z)=C_{qmp}J_m\left(\frac{\eta_{pm}r}{a}\right)\left\{\begin{matrix}\cos(m\theta)\\ \sin(m\theta)\end{matrix}\right\}\cos\left(\frac{q\pi z}{L}\right) \quad (3)$$

which yields degenerate modes except when m=0. Note that $C_{qmp}$ is the modal amplitude, $J_m$ is the m-th order Bessel function with corresponding roots, $\eta_{pm}$ and a is the radius of the enclosure. Since the enclosure is driven uniformly at each end, the only modes of concern are the axial modes for which m=0 and p=1. The corresponding natural frequencies to these modes can be computed as follows:

$$\omega_n=c\sqrt{\left(\frac{q\pi}{L}\right)^2+\left(\frac{\eta_{pm}}{a}\right)^2} \quad (4)$$

Figure 5:
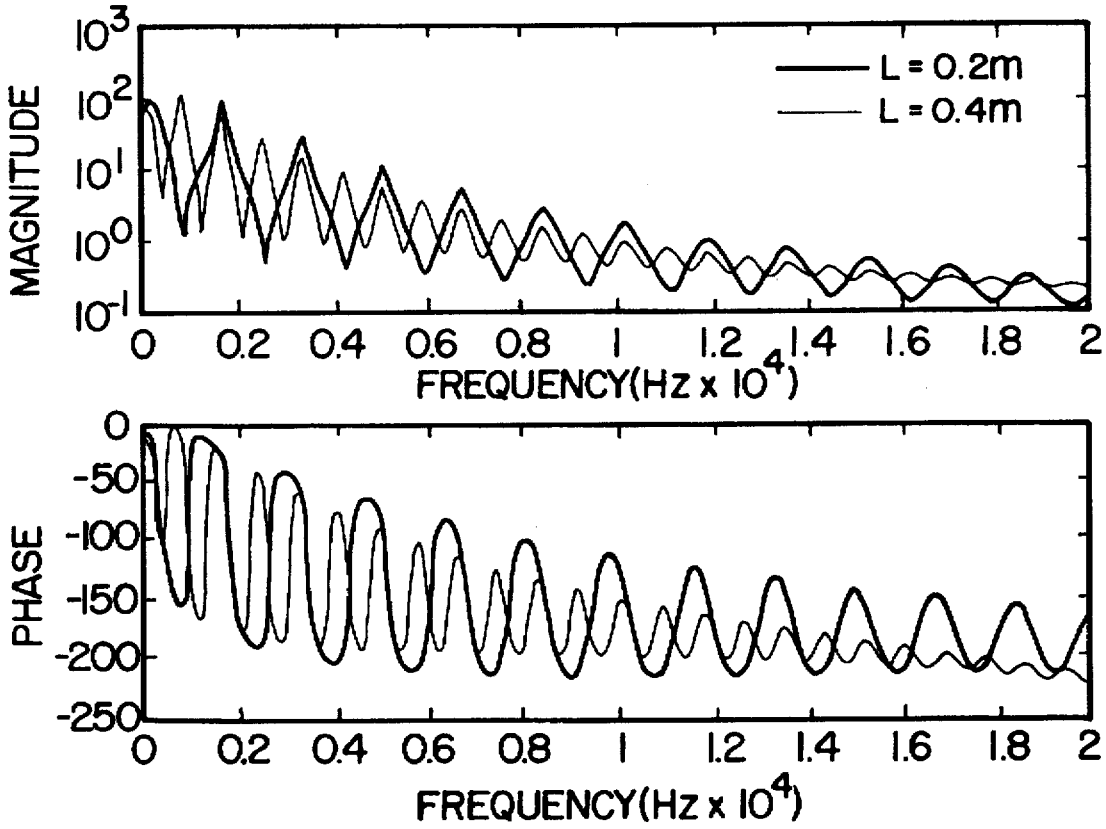
FIG. 5 illustrates a typical, interior acoustic frequency response of the cylindrical enclosure when driven by a speaker at one end as depicted in the embodiment of FIG. 1.

The acoustic modes excited by the transduction devices yield $\eta_{10}=0$, and thus the natural frequencies are inversely proportional to the length. A typical plot of an acoustic frequency response function is presented in FIG. 5. As illustrated, the standing waves within the cylindrical enclosure are equally spaced in frequency as a function of the modal index, q. Thus, increasing the length of the enclosure increases the modal density of the acoustic modes. The acoustic frequency responses of two cylindrical enclosures, one with double the length of the other are presented in FIG. 5. It is evident that doubling the length doubles the number of standing waves within the enclosure.

This increase in modal density and corresponding standing waves would be of concern if the cylindrical structure itself were lightly damped. However, by proposing a dampening agent with a dampening ratio of greater than 0.5, such as a viscoelastic, material like Butyrate, the structural acoustic response of the system is relatively small compared to that of each loudspeaker. Thus, the vibration of the cylinder induced by the interior acoustic modes has very little effect on the acoustic field.

A structural model of the cylinder was formulated for clamped-clamped boundary conditions and based upon the typical dimensions of the enclosure, the fundamental resonance frequency of the cylindrical structure is approximately 570 Hz, well above the low-frequency audible range. Due to the inherent damping of the material, these structural modes are of little concern in the acoustic response of the loudspeaker system.

Figure 6:
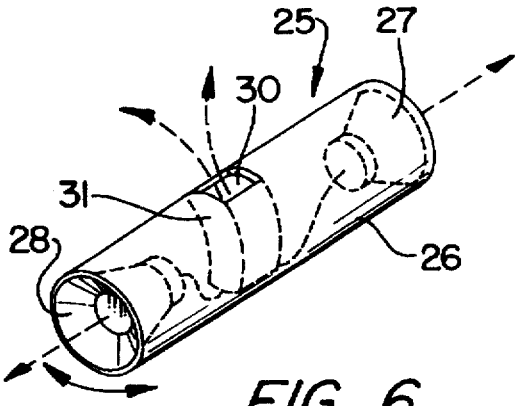
FIG. 6 illustrates an alternative embodiment of a sound system in accordance with FIGS. 1 and 2 having a tuned-port formed therein.

Turning to FIG. 6, a second embodiment of the sound system 25 is illustrated having a cylindrical enclosure 26 having an audio driver 27, 28 mounted in each end thereof, which are both full-range drivers in accordance with the embodiments of FIGS. 1 and 2. In this second embodiment, an opening 30 within the cylindrical enclosure 26 is used to create an acoustic center field image, which opening is sized to at least half the radius of one of the drivers 27 or 28, and includes a passageway or length of tubing 31 which is arcuately shaped to follow the wall contour of the cylindrical enclosure 26. The tubing 31 is the same length as the diameter of the hole 30 and is set to produce a tuned Helmholtz port to produce an acoustical center field for the system 25. The resonance frequency of the volume of air within the tubing 31 is tuned at a sufficiently low frequency such that the acoustic response of the port is in-phase with the acoustic response of the transduction devices 27 and 28 mounted at each end of the enclosure. The stiffness of the tubing is such that the higher frequencies are effectively filtered and, thus, the Helmholtz port serves primarily to enhance the low-frequency response of the system.

In an alternative configuration, the acoustic port can be tuned to enhance the mid-range response of the loudspeaker system in the acoustic near-field for applications to video games when the observer is typically positioned in the near-field. In either case, the port can be configured with a variable aperture such that it can be opened, or fully closed, to meet the needs of a particular observer.

Figure 7:
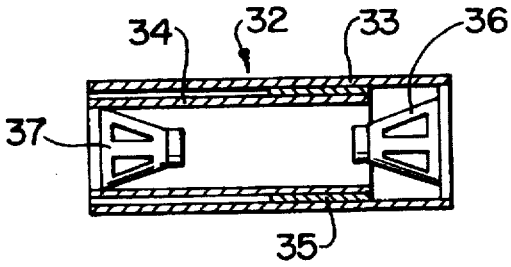
FIG. 7 depicts another embodiment of a loudspeaker system having a pair of telescoping, cylindrical enclosures in a fully closed position.
Figure 8:
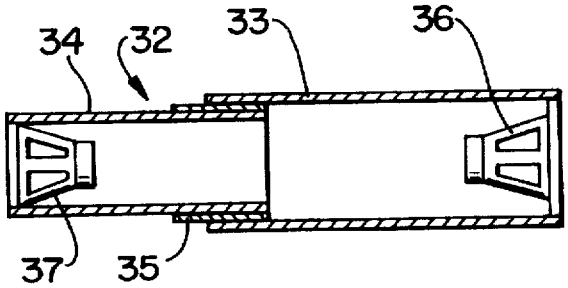
FIG. 8 illustrates a sectional view of the embodiment of FIG. 4 having the cylindrical enclosures in the fully opened position.
Figure 3:
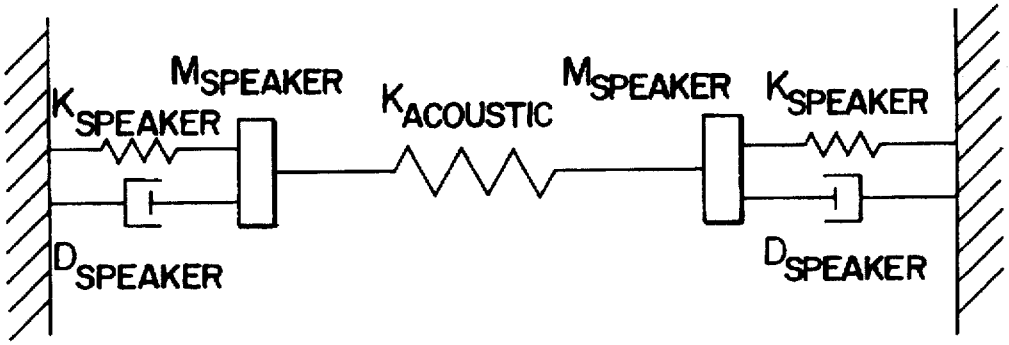
FIG. 3 depicts a simple schematic diagram of the dynamic mechanical system used to derive the frequency response presented in FIG. 4.

Another alternative embodiment of the loudspeaker system is depicted in FIGS. 7 and 8 in which two concentric cylindrical enclosures are mated such that the outer enclosure 33 is capable of telescoping motion with respect to the inner enclosure 34. The sliding is adjusted by press-fit, but can have, with one of the cylindrical enclosures, raised thin ridges 35 to slightly space the enclosure 33 from the enclosure 34 to allow the escape of air pressure from between the two cylindrical enclosures. Cylindrical enclosure 33 has an acoustical driver 36 mounted at one end thereof while enclosure 34 has an acoustical driver 37 mounted in the end thereof so that the cylindrical enclosures 33 and 34 act as a single composite enclosure with an adjustable volume, providing a means of tuning the low-frequency response of the sound system by effectively adjusting the stiffness associated with the acoustic volume enclosed by the telescoping cylindrical enclosure. In addition, the cylindrical enclosures may or may not have the ridges 35, which allow the escape of air pressure from the back wave of the drivers 36 and 37 through the arcuate spacing formed by the ridges, slightly spacing the enclosures one from the other While maintaining a tight fit of the enclosures to each other. It, of course, will be clear that a small screw or the like can be used to lock the cylindrical enclosures together at any predetermined length without departing from the spirit and scope of the invention.

Figure 9A:
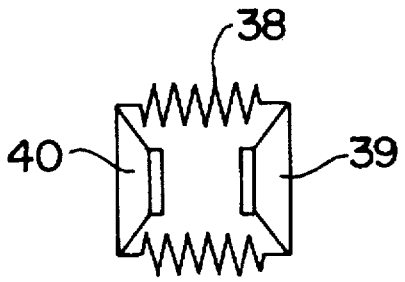
FIG. 9 illustrates a sectional view of an embodiment constructed from a "folding" enclosure for modifying the length.
Figure 9B:
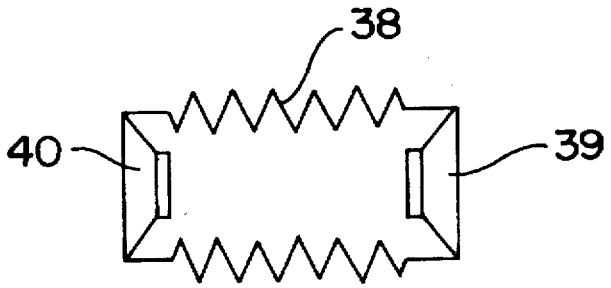
Figure 9C:
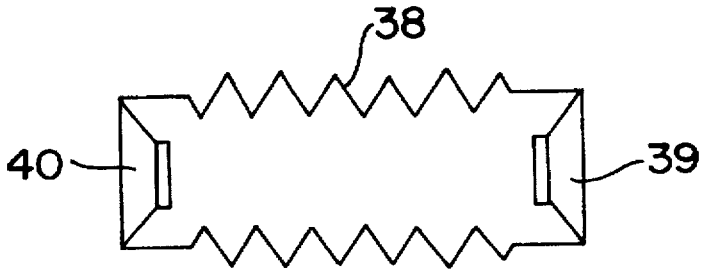

An alternative of the variable volume enclosure is depicted in FIG. 9. A folding enclosure 38 capable of expanding and contracting to various lengths is illustrated in FIGS. 9(*a*)–9(*c*), and is configured with two transducers 39 and 40, one each mounted in each end of the enclosure. This alternative embodiment is used to accomplish the same task as the telescoping enclosure presented in FIGS. 7 and 8.

The invention thus provides a compact loudspeaker system capable of wide-band performance with enhanced bass performance and effective directionality. The choice of structural materials and design configuration results in a compact loudspeaker system uniquely different from previous realizations and capable of delivering a full-range acoustic field in an environment previously limited to the bass frequency range.

The system has a variety of significant applications. The compact wide-band loudspeaker system can be placed in front of a television set or even mounted in the housing of a television to extend slightly from either side thereof and can be used in connection with computer monitors with very small amplified signals to produce sound in connection with multi-media systems typically associated with CD-ROM drives.

The compact full range loudspeaker system of the invention has been described above with a great deal of particularity to illustrate preferred and alternative constructions. It is not intended, however, that the invention is so limited. Accordingly, the invention and its scope should be determined from the appended claims and not this disclosure.

We claim:

1. A compact, full range loudspeaker system comprising:

a compact elongated enclosure having a hollow interior joining two opposing open ends and, characterized by a resonant frequency;

two audio loudspeakers, each having an audio bandwidth of response extending from 500 Hz to at least 10 kHz and a diameter of less than 4.25 inches, one of said two audio speakers being mounted in each of said open ends, aligned axially and facing outwardly, said elongated enclosure length being greater than or equal to twice the radius of each of said two audio loudspeakers;

signal cables connected to said two audio speakers for delivering driving signals to each of said two audio loudspeakers; and dampening means forming at least part of the elongated enclosure, wherein said dampening means limits the structural acoustic response around the resonant frequency of the enclosure.

2. The loudspeaker system of claim 1, wherein said dampening means is provided by constructing said elongated enclosure substantially of a dampening material.

3. The loudspeaker system of claim 1, wherein said dampening means is provided by coating the interior of said elongated enclosure with a dampening material.

4. The loudspeaker system of claim 3, wherein the dampening means is a viscoelastic material.

5. The loudspeaker system of claim 4, wherein the viscoelastic dampening means is Butyrate 565.

6. The loudspeaker system of claim 1, wherein said dampening means is provided by coating the exterior of said elongated enclosure with a dampening material.

7. The loudspeaker system of claim 1, wherein the enclosure is circular in cross section.

8. The loudspeaker system of claim 1, comprising a pair of sound boards, each having a reflective surface positioned in line with the axis of said cylindrical enclosure, one each in front of each respective audio loudspeaker at each end of the enclosure.

9. The loudspeaker system of claim 1, wherein said elongated enclosure has a flat surface attached thereto for supporting said enclosure at some predetermined position.

10. The loudspeaker system of claim 1, wherein said elongated enclosure is formed from a pair of telescoping cylindrical enclosures for adjusting the volume within said cylindrical enclosure.

11. The loudspeaker system of claim 1, wherein said cylindrical enclosure is a single enclosure having a tuned port formed therein opening through the side of said tube between the ends thereof and a variable aperture configured on the port to allow for closing the port.

12. The loudspeaker system of claim 1, wherein the length of the elongated enclosure is less than 0.5 m.

13. The loudspeaker system of claim 1, wherein the length of the elongated enclosure is less than 0.25 m.

14. The loudspeaker system of claim 1, wherein the bandwidth of response extends substantially from 20 Hz to at least 15 kHz.

15. The compact, full-range loudspeaker system according to claim 1, wherein the diameter of each of said two audio loudspeakers is less than or equal to 2.5 inches.

16. A compact, full-range loudspeaker system comprising:

a sound source including an audio amplifier for delivering at least two channels of stereo signals to drive at least two audio loudspeakers;

a compact elongated enclosure having a hollow interior joining two opposing open ends and characterized by a resonant frequency;

two audio loudspeakers, each having a full-range audio bandwidth of response and a diameter of less than 4.25 inches, one of said two audio loudspeakers being mounted in each of said open ends, aligned axially and facing outwardly, said elongated enclosure length being greater than or equal to twice the radius of each of said two audio loudspeakers;

signal cables connected to said two audio loudspeakers for delivering driving signals to each of said two audio loudspeakers from said sound source; and dampening means forming at least part of the elongated enclosure, wherein said dampening means limits the structural acoustic response around the resonant frequency of the enclosure.

17. The compact, full-range loudspeaker system according to claim 15, wherein the diameter of each of said two audio loudspeakers is less than or equal to 2.5 inches.

* * * * *